United States Patent [19]

Chang

[11] Patent Number: 4,603,784

[45] Date of Patent: Aug. 5, 1986

[54] NURSING BOTTLE SYSTEM

[76] Inventor: Wei C. Chang, 145 4th Ave., Mt. Vernon, N.Y. 10550

[21] Appl. No.: 815,451

[22] Filed: Dec. 31, 1985

[51] Int. Cl.[4] ..... A61J 9/00; B65D 23/00

[52] U.S. Cl. ..... 215/11 R; 215/6; 215/10

[58] Field of Search ..... 215/6, 10, 11 R, 11 A–11 D; 220/20, 22; 206/499, 503, 516

[56] References Cited

U.S. PATENT DOCUMENTS

| | | | |
|---|---|---|---|
| 2,326,414 | 8/1943 | Thompson | 215/6 X |
| 2,611,499 | 9/1952 | Mayer | 215/6 |
| 2,628,913 | 2/1953 | Horan | 215/11 E X |
| 2,833,436 | 5/1958 | Ruderain | 215/6 |
| 2,843,281 | 7/1958 | Gallois | 215/6 X |
| 2,876,113 | 3/1959 | Barton | 215/11 E X |
| 2,907,485 | 10/1959 | Lunden | 215/11 R |
| 3,134,494 | 5/1964 | Quinn | 215/11 E |
| 3,327,881 | 6/1967 | Maier | 215/6 |
| 3,371,807 | 3/1968 | Clouser et al. | 215/6 |
| 3,465,905 | 9/1969 | Schottanes | 215/6 |
| 3,744,622 | 7/1973 | Weaver | 215/6 X |

FOREIGN PATENT DOCUMENTS

| | | | |
|---|---|---|---|
| 550864 | 12/1957 | Canada | 215/6 |

*Primary Examiner*—William Price
*Assistant Examiner*—Sue A. Weaver
*Attorney, Agent, or Firm*—Leo Zucker

[57] ABSTRACT

A nursing bottle system includes axially joined first and second container bodies or portions. The container bodies are liquid tightly separated from one another by a wall extending perpendicularly to the container axis. Different liquid foods can be carried in the container bodies, and fed as desired to an infant through a nipple provided at the open end of the selected container body of the system.

13 Claims, 6 Drawing Figures

NURSING BOTTLE SYSTEM

BACKGROUND OF THE INVENTION

1. Field of the Invention

The present invention relates generally to nursing bottles for infants, and particularly to a nursing bottle system which allows two different liquid foods to be dispensed from separate container portions joined to one another as a single unit.

2. Discussion of the Known Art

A liquid infant food dispenser arrangement is known from U.S. Pat. No. 2,628,913 issued Feb. 17, 1953, by which two or more identical liquid-filled bags or flasks are carried in a single can body or jar. The structure of the dispenser arrangement is relatively complex, and each bag must be removed from the can or jar prior to dispensing its liquid contents to the infant.

Containers in which two different liquids can be carried separately are known from U.S. Pat. No. 2,611,499 issued Sept. 23, 1952, and U.S. Pat. No. 3,465,905 issued Sept. 9, 1969. The containers are not, however, of the kind from which liquid foods can be dispensed to an infant and, like the dispenser arrangement of the '913 patent, are of a fairly complex structure.

SUMMARY OF THE INVENTION

An object of the present invention is to provide a nursing bottle system capable of dispensing a desired one of two different foods to an infant.

Another object of the invention is to provide a nursing bottle system which can be easily carried as a single unit.

A further object of the invention is to provide a nursing bottle system with which different liquid foods can be dispensed from separate container bodies or portions without the need for a can or jar for holding the container bodies.

According to one embodiment of the invention, a nursing bottle system includes an integrally formed plastics container body, and a dividing wall formed integrally with and extending perpendicularly to the axis of the container body to divide the interior of the body into first and second container portions liquid tightly sealed from one another. A pair of nipples are adapted to be sealingly fitted to a corresponding open end of the container body, and cap means associated with each of the nipples secures the nipples to the open ends of the container body. The cap means can be placed in a first configuration in which the nipple faces inwardly of the container body and the body can be placed in a standing position on the cap means, or a second configuration in which the nipple faces outwardly from the container body for delivering a liquid food in the associated container portion to an infant.

Accordingly, two different liquid foods can be carried by the container body each in a corresponding one of the first and the second container portions, and dispensed selectively to the infant when the cap means associated with the container portion in which the selected liquid food is carried is placed in the second configuration.

In a second embodiment, the present nursing bottle system includes first and second plastics container bodies each with an open top end and a closed bottom wall. A pair of nipples are adapted to be sealingly fitted to the open ends of the container bodies, and cap means associated with each of the nipples secures the nipples to the open ends of the container bodies.

Fastening means is provided for detachably joining the first and the second container bodies to one another with the closed bottom walls in confronting relation. Thus, two different liquid foods can be carried by the first and the second container bodies when joined to one another, and the liquid foods can be fed selectively to an infant when the container bodies are either joined or detached from one another.

The various features of the novelty which characterize the invention are pointed out with particularity in the claims annexed to and forming a part of the present disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
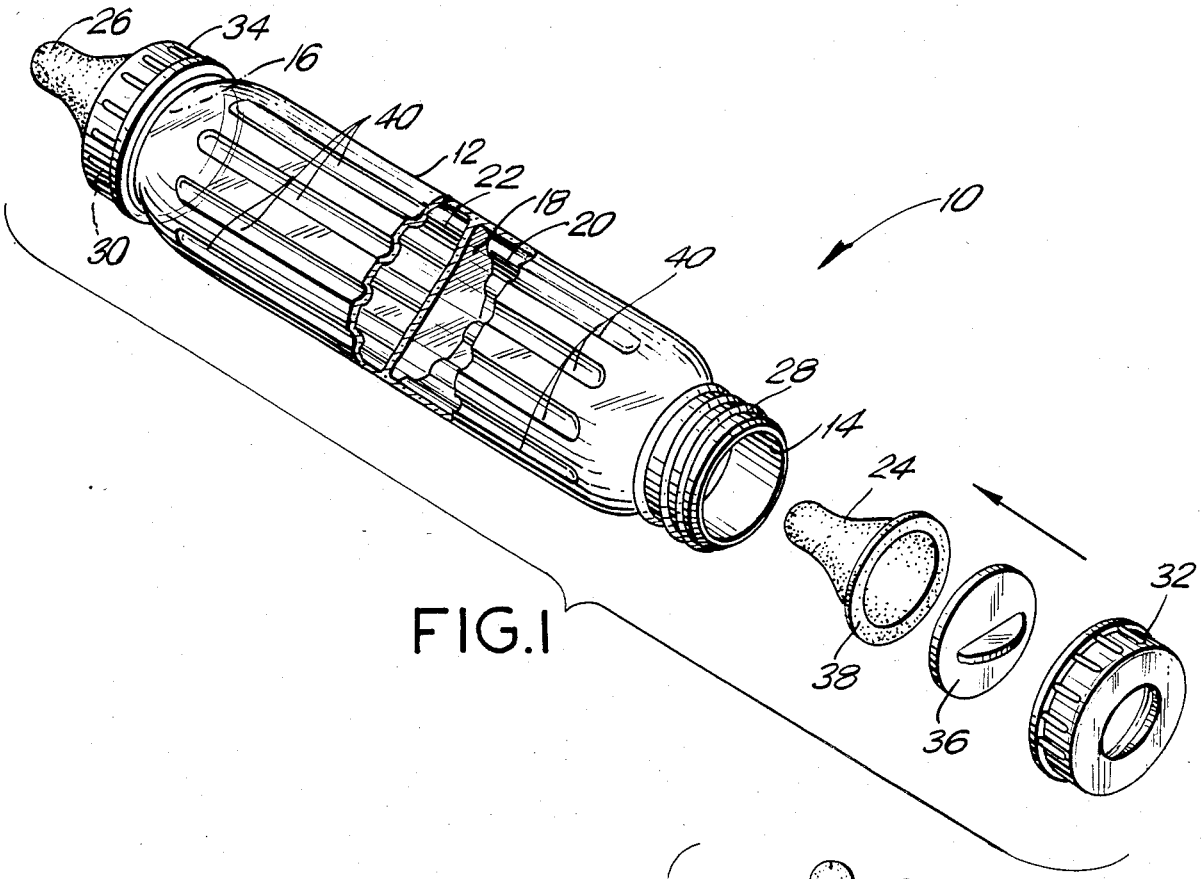
FIG. 1 is a perspective assembly view of a nursing bottle system according to the invention, with parts broken away to show an interior wall.

FIG. 1 shows a nursing bottle system 10 according to a first embodiment of the present invention.

Basically, the system 10 includes an integrally formed generally cylindrical container body 12, preferably made of transparent or semi-transparent plastics material. The container body 12 has open ends 14, 16 along its axis, and a dividing wall 18 formed with and extending perpendicular to the axis of the container body 12. Dividing wall 18 is preferably located medially of the open ends 14, 16 of the container body 12, and serves to divide the interior space of the body 12 into first and second container portions 20, 22 which portions are liquid tightly sealed from one another.

A pair of nipples 24, 26 are provided, one at each of the open ends 14, 16 of the container body 12. Nipples 24, 26 can be identical to one another and of conventional form. Each of the open ends 14, 16 of the container body 12 has a threaded neck portion 28, 30 for engaging a correspondingly threaded nipple cap 32, 34. The nipple caps 32, 34 each have a central opening through which the nipples 24, 26 can protrude when the caps 32, 34 are screwed onto the corresponding neck portions 28, 30.

Until a liquid food contained within either of the container portions 20, 22 is to be dispensed to an infant, it is preferred that the associated nipples 24, 26 be placed in a first configuration in which the nipple faces inwardly into the corresponding open end of the container body 12, as shown at the right-hand side of FIG. 1. In such configuration, a plastics or rubber end cap 36 is interposed between, for example, a shoulder seal 38 on the nipple 24, and the threaded nipple cap 32. Thus, any liquid food which may enter the interior of the nipple 24 is prevented by the end cap 36 from escaping through the central opening in the nipple cap 32 when the latter is screwed down firmly.

Figure 2:
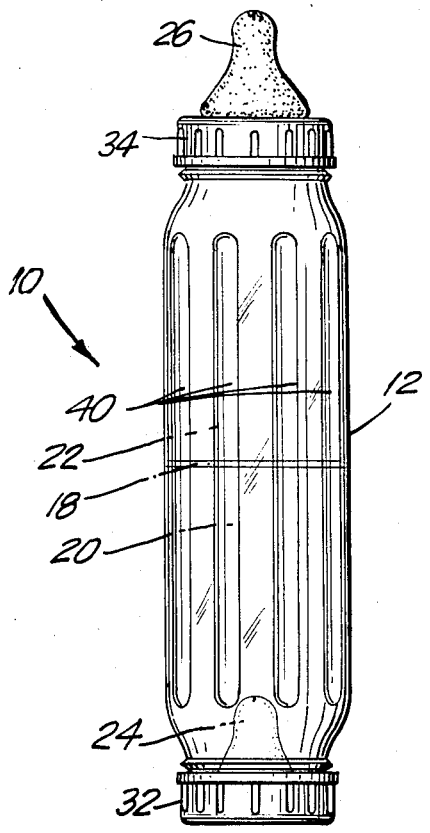
FIG. 2 is an elevational view of the nursing bottle system of FIG. 1 when assembled in a particular configuration.

As shown in FIG. 2, when the nipple 24 is capped inwardly of the container body 12, the entire nursing bottle system 10 can be placed in a standing position on the nipple cap 32.

In order to prevent the container body 12 from rolling when placed on its side atop, for example, a table, a number of axially extending flat surface portions 40 are formed about the circumference of the container body 10, the flat surface portions 40 being equally circumferentially spaced from one another. Preferably, eight such flat surface portions 40 are formed on the outer circumference of the container body 10.

In use, one of the container portions 20, 22 can be filled with infant milk, and the other portion can be filled with juice, water or other liquid food. The entire system 10 is much easier to carry instead of two separate nursing bottles as has been the common practice when two dferent liquid foods must be available for an infant during a trip away from home.

The materials from which the entire system 10 is formed should be washable with soft detergents and easily sterilizable at elevated temperatures. Heating of the present nursing bottle system 10 so as to warm its liquid contents preferably should be performed by immersion in hot water. Microwave oven heating is not recommended since such form of heating may damage any plastics components of which the system 10 is formed.

A typical overall length for the container body 10 between the open ends 14, 16 is about nine inches (22.86 cm) maximum.

Figure 3:
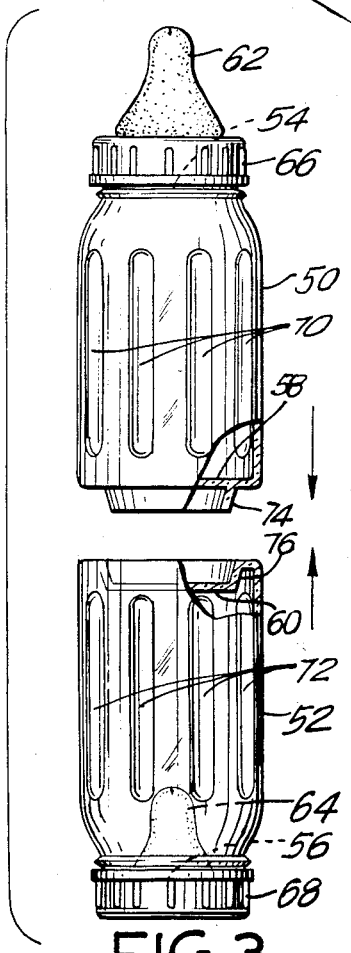
FIG. 3 is an elevational assembly view of a nursing bottle system according to a second embodiment of the invention.

FIG. 3 shows another embodiment of the nursing bottle system of the present invention. First and second generally cylindrical container bodies 50, 52, preferably formed of plastics material, each have an open end 54, 56 and a closed bottom wall 58, 60. A pair of nipples 62, 64 are adapted to be fitted in sealing relation to the open ends 54, 56 of the container bodies 50, 52, by threaded nipple caps 66, 68, respectively. Each of the container bodies 50, 52 may also have a set of eight axially extending flat surface portions 70, 72, equally spaced from one another about the circumference of the body portion, to prevent rolling as in the embodiment of FIGS. 1 and 2.

The first and second container bodies 50, 52 can be detachably joined to one another along the axial direction with the closed bottom walls 58, 60 in confronting relation. When so joined, the system will resemble that of FIGS. 1 and 2 and provide like advantages, as well as allowing an infant to be fed with the container bodies 50, 52 either joined or detached from one another.

In FIG. 3, the bottom parts of the container bodies 50, 52 form fastening means for detachably joining the container bodies to one another. Specifically, the bottom part of container body 50 includes a first annular flange 74 which projects from the bottom wall 58, the flange 74 being tapered slightly inwardly in the radial direction as the flange 74 extends further away from the bottom wall 58. The bottom part of the container body 52 forms another annular flange 76 which tapers slightly radially outwardly with increasing distance from the bottom wall 60. Flange 74 is formed to be received within and to engage the flange 76 with a force fit when the container bodies 50, 52 are urged against one another with their bottom walls 58, 60 in confronting relation. Sufficient resiliency should be provided by a plastics material from which the container bodies 50, 52 are made, including the flanges 74, 76, so as to allow a force fit to be realized and to serve as a means for detachably joining the container bodies 50, 52 to one another. Particular dimensions for the thicknesses of the flanges 74, 76 and their relative positions would be apparent to one skilled in the relevant art.

Figure 4:
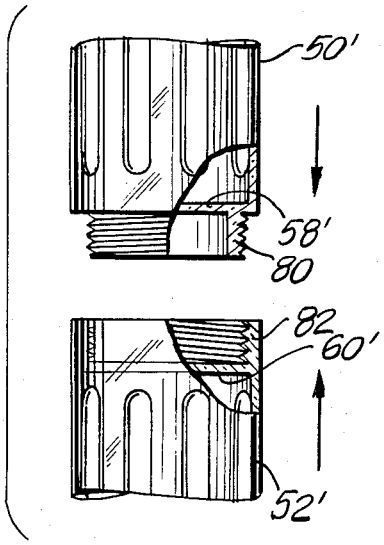
FIG. 4 is a partial elevational view similar to FIG. 3 and showing different fastening means.

FIG. 4 shows an alternative arrangement for fastening separate container bodies as in the embodiment of FIG. 3, to one another. In the FIG. 4 arrangement, the bottom part of a container body 50' has an annular flange 80 projecting from its bottom wall 58'. A male thread is formed on the outer periphery of the flange 80. The bottom part of container body 52' has an annular flange 82 projecting from its bottom wall 60'. The flange 82 has a female thread formed on its inner periphery, for engaging the thread on the flange 80 of the container body 50'.

Figure 5:
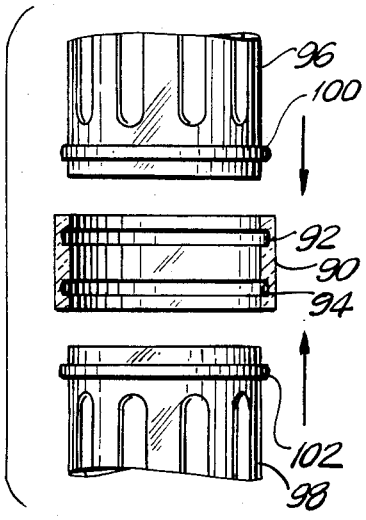
FIG. 5 is a partial elevational view similar to FIG. 3, in which the fastening means includes a separate flat ring member.
Figure 6:
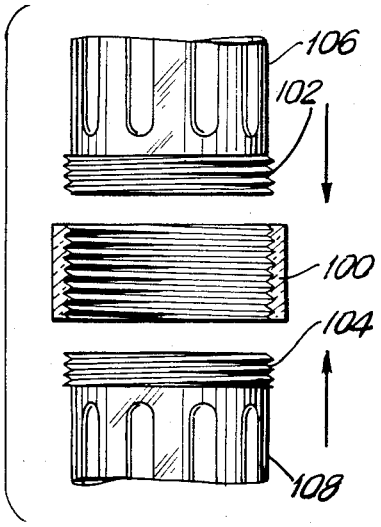
FIG. 6 is a partial elevational view similar to FIG. 5, showing another form for the flat ring member as fastening means.

FIGS. 5 and 6 show another variation of the embodiment of the present nursing bottle system in which separate container bodies are provided. In the arrangements of FIGS. 5 and 6, it is possible to form the separate container bodies identically with one another, thus reducing manufacturing costs and allowing any two of a number of like container bodies filled with different liquid foods to be joined conveniently to one another, according to the present invention In FIG. 5, a flat ring member 90 has two circumferential recesses 92, 94 formed in its inner periphery, the recesses 92, 94 being axially spaced apart from one another. Each of a pair of container bodies 96, 98 to be joined to one another has an annular protrusion 100, 102 extending radially outwardly from its circumference, near the bottom wall of the container body 96, 98. The recesses 92, 94 in the flat ring member 90 are dimensioned to engage the annular protrusions 100, 102 securely when the container bodies 96, 98 are urged toward one another with their bottom walls in confronting relation and the ring member 90 placed about the bottom parts of the container bodies 96, 98. The materials of which the container bodies 96, 98 and the ring member 90 are formed should be of sufficient resiliency to allow the protrusions 100, 102 to be forced through the open ends of the ring member 90 until they are seated within the corresponding recesses 92, 94.

With each of the container bodies 96, 98 of a height of about 4.5 inches (11.43 cm), the axial length of the ring member 90 should be about one inch (2.54 cm).

In FIG. 6, a ring member 100 is provided with a thread formed on its inner periphery. Corresponding threads 102, 104 are formed on the circumference of lower portions of container bodies 106, 108, for engaging the internal thread of the ring member 100.

While the foregoing description represents preferred embodiments of the present invention, it will be obvious to those skilled in the art that various changes and modifications may be made, without departing from the true spirit and scope of the present invention.

I claim:

1. A nursing bottle system, comprising:

an integrally formed generally cylindrical container body of plastics material;

a dividing wall integrally formed with and extending perpendicular to the axis of said container body, for dividing the interior space of said body into first and second container portions which are liquid tightly sealed from one another;

a pair of nipples each adapted to be fitted in sealing relation to a corresponding open end of said container body; and cap means associated with each of said nipples for securing said nipples to the correspondg open ends of said container body in a selected one of a first configuration in which the nipple faces inwardly into the corresponding open end of said container body and said body can be placed in a standing position on said cap means, and a second configuration in which the nipple faces outwardly from the corresponding open end of said container body for delivering a liquid food from the associated container portion to an infant;

wherein two different liquid foods can be carried by said container body each in a corresponding one of said first and said second container portions, to be fed selectively to the infant when the cap means associated with the container portion in which the selected liquid food is carried is placed in the second configuration.

2. A system according to claim 1, wherein said dividing wall is located medially of the open ends of said container body.

3. A system according to claim 1, wherein said container body is formed with a number of axially extending flat surface portions equally spaced from one another about the circumference of said body to prevent said body from rolling when placed on its side.

4. A nursing bottle system, comprising:

first and second generally cylindrical container bodies of plastics material, each having an open top end and a closed bottom wall;

a pair of nipples each adapted to be fitted in sealing relation to the open end of a corresponding one of said container bodies;

cap means associated with each of said nipples for securing said nipples to the open ends of said container bodies; and fastening means for detachably joining said first and said second container bodies axially to one another with their closed bottom walls in confronting relation, so that two different liquid foods can be carried by said first and said second container bodies when joined to one another, and said liquid foods can be fed selectively to an infant when said container bodies are either joined or detached from one another.

5. A system according to claim 4, wherein said fastening means comprises a bottom part of each of said first and said second container bodies.

6. A system according to claim 5, wherein the bottom part of said first container body includes a first annular flange projecting from said bottom wall, the bottom part of said second container body includes a second annular flange projecting from said bottom wall, and said second flange is formed to be received within and to engage said first flange.

7. A system according to claim 6, wherein said first and said second flanges are threaded.

8. A system according to claim 6, wherein said first and said second flanges are dimensioned to establish a force fit with one another.

9. A system according to claim 4, wherein said fastening means comprises a flat ring member.

10. A system according to claim 9, wherein said flat ring member has two circumferentially extending recesses axially spaced apart from one another on the inner periphery of said ring member, and each of said first and said second container bodies has a protrusion extending radially outwardly from its circumference near said bottom wall, for engaging a corresponding one of said recesses when said ring member is placed about the bottom part of the container body.

11. A system according to claim 10, wherein said first and said second container bodies are identical in form to one another.

12. A system according to claim 9, wherein said flat ring member has threads formed on its inner periphery, and each of said first and said second container bodies has corresponding threads formed on the circumference of a lower portion of the container body for engaging the threads of said ring member.

13. A system according to claim 12, wherein said first and said second container bodies are identical in form to one another.

* * * * *